United States Patent [19]

Tsay

[11] Patent Number: 4,929,006

[45] Date of Patent: May 29, 1990

[54] STRUCTURE OF SEALING STRING

[76] Inventor: Wen-Her Tsay, No. 29, Lane 111, Cheng-Ho Road, Kaohsiung, R.O.C., Taiwan

[21] Appl. No.: 234,744

[22] Filed: Aug. 22, 1988

[51] Int. Cl.[5] ..... B65D 33/34

[52] U.S. Cl. ..... 292/324; 292/319

[58] Field of Search ..... 292/327, 318, 319, 324; 411/352, 353

[56] References Cited

U.S. PATENT DOCUMENTS

| | | | |
|---|---|---|---|
| 3,730,578 | 5/1973 | Gerlach | 292/318 |
| 3,975,040 | 8/1976 | Van Gompel | 292/318 |
| 3,980,337 | 9/1976 | Moberg et al. | 292/319 |
| 4,280,726 | 7/1981 | McCoag | 292/327 |
| 4,626,009 | 12/1986 | Burnett et al. | 292/327 |
| 4,722,562 | 2/1988 | Burt | 292/318 |
| 4,802,699 | 2/1989 | Smith | 292/327 |

*Primary Examiner*—Alexander Grosz
*Assistant Examiner*—Michael J. Milano
*Attorney, Agent, or Firm*—Nixon & Vanderhye

[57] ABSTRACT

The lock seal includes a body comprised of two mating shells having grooves generally complementary in shape to and for reception of lock retention sleeves. The sleeves are axially aligned in the shells and have frustoconically shaped portions for receiving interiorly thereof split rings. A wire has a locking element at one end for reception in the body when assembled, whereas the opposite end carries a locking rod having axially spaced grooves. Upon insertion of the locking rod into the open end of the body, the locking rings are expanded against the walls of the frustoconically shaped sleeves to prevent withdrawal of the rod from the body.

3 Claims, 5 Drawing Sheets

STRUCTURE OF SEALING STRING

BACKGROUND AND SUMMARY OF THE INVENTION

The present invention relates to a locking seal and particularly relates to a lock seal having excellent locking characteristics and which may be fabricated at low cost.

In conventional types of locking seals, a thick material is used for the fabrication of the buckling sleeve ring as a means to achieve a better sealing effect. Thus, a larger force has to be applied and, furthermore, a more complicated fabrication process is also involved. This increases the cost of fabrication and is very unfavorable to those end users whose volume of consumption is extremely large. The invention therefore improves the structure of such conventional lock seal and provides a lock seal having an excellent sealing or locking effect, and low fabrication cost.

The lock seal hereof affords an improvement in the structure of a conventional type of lock seal. It not only has an excellent locking feature, but may be fabricated at low cost, thereby providing end users with an excellent product to take the place of a conventional lock seal.

As is commonly acknowledged, a lock seal is a locking device which is employed to pass through and lock up a casing body or a box body. By using the lock seal, articles contained in the box or case will not be lost. Moreover, if the lock seal is disassembled or damaged by a burglar, it will be readily discovered by the owner of the box or case by examining the outer appearance of the lock seal, thereby achieving the object of preventing thievery of the contents of the case or box.

There are many different purposes for which a lock seal may be utilized and these can be roughly categorized into two types. The first one is of a light load type. Because it is utilized for a temporary locking purpose, no heavy locking effect will be required. The second one is related to the invention and is of a heavy load type. It is used to lock a case or box, for example, the van of a truck, to prevent the contents thereof from being stolen.

According to the design of the present invention, the locking effect can be brought to its full play by having a lock retention sleeve formed out of a metallic sheet to match with another metallic sheet having a circular hole and a spring toggle with a gap, i.e., a split ring, to facilitate the insertion and buckling of a circular rod having a ring groove. However, some changes may be made to its outer shell to cope with the various requirements of utilization, for which a basic demonstrative example is shown in FIGS. 1 and 5.

In a preferred embodiment according to the present invention, there is provided a lock seal comprising a housing, with at least two lock retention sleeves disposed in the housing, each of the sleeves having a frustoconical portion defining large and small diameter opposite ends and a radially outwardly directed flange adjacent the larger diameter end thereof extending in a plane generally normal to the axes of the frustoconical sleeve portion, the sleeve being axially aligned within said housing. A split ring is disposed within each of the frustoconical portions of the sleeves and means are provided for retaining the split ring within the sleeve and enabling axial movement thereof. Also provided is a flexible element having opposite ends, with means cooperable between one end of the element and the housing for retaining the one end of the element in the housing. A pin is carried by the opposite end of the flexible element, receivable axially within the sleeves, the pin having a plurality of circumferentially extending, axially spaced grooves, the split ring having an internal diameter smaller than the diameter of the pin such that each ring will at first expand upon insertion of the pin and then contract in a pin groove to retain the pin within the body upon attempted retracting movement of the pin from the body.

These and further objects and advantages of the present invention will become more apparent upon reference to the following specification, appended claims and drawings.

DESCRIPTION OF THE DRAWING FIGURES

FIG. 9 is an enlarged cross-sectional view of a portion of the locking seal illustrated in FIG. 8.

FIG. 10 is a perspective view of another embodiment of the present invention; and FIG. 11 is a perspective view with portions broken out and in cross-section illustrating the locking seal of FIG. 10 in a locked condition.

DETAILED DESCRIPTION OF THE DRAWING FIGURES

Figures 1, 2:
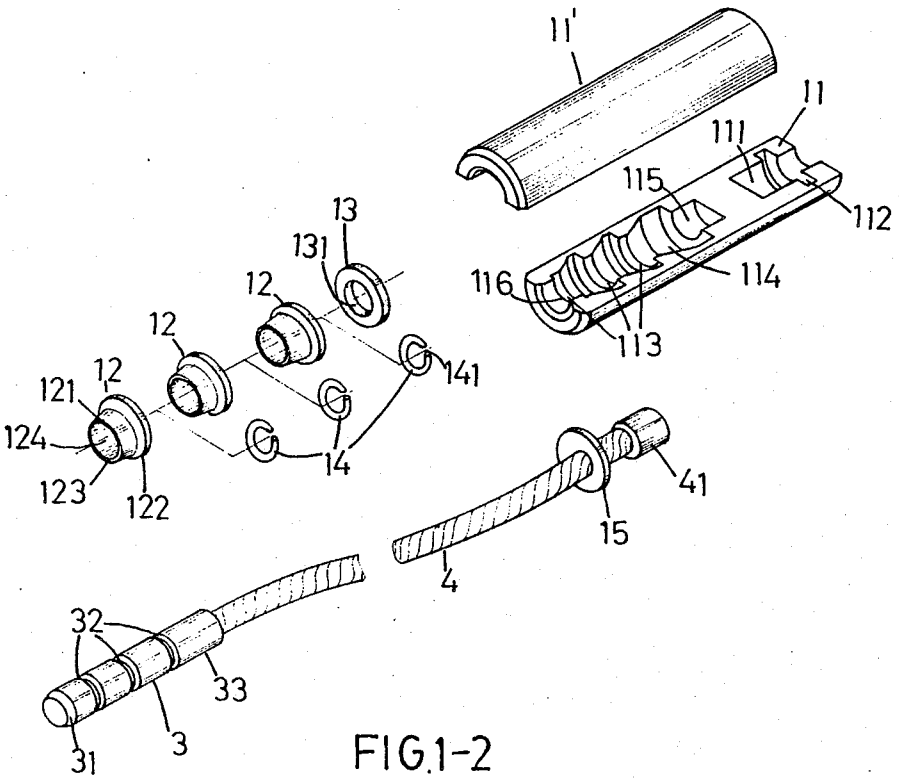
FIG. 2 is a reduced cross-sectional view with parts broken out of the locking seal illustrated in FIG. 1.
Figure 1:
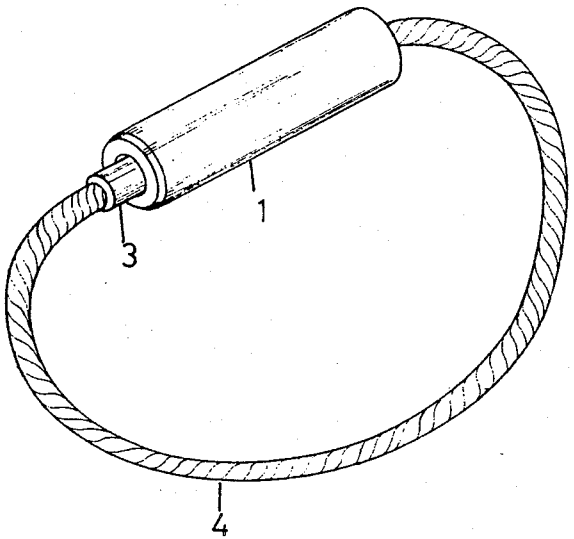
FIG. 1A is a perspective view of a locking seal constructed in accordance with the present invention.
FIG. 1B is an exploded view of the parts of the locking seal illustrated in FIG. 1A.
Figure 2:
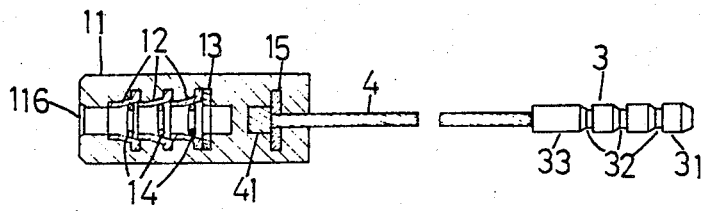

Reference will now be made in detail to the present preferred embodiment of the invention, an example of which is illustrated in the accompanying drawings.

A locking seal according to the present invention includes a sleeve body 1, a generally cylindrical locking rod 3 and a wire 4. Body 1, as illustrated in FIG. 1B, includes semi-cylindrical elongated sleeves or shells 11 and 11' shaped along their interior surfaces to receive a plurality of elements internal to the sleeve body 1. Such elements include a plurality of generally frustoconically shaped tubular retention sleeves 12 each having a radial flange at one end, a cylindrical section at its opposite end, and a frustoconical sleeve connecting between the opposite ends. Sleeves 12 may be formed by a metal punching operation. An annular ring 13 is also provided. The opening 123 in each of sleeves 12 and the bore 131 of annular ring 13, when axially aligned in position within body 1, has a diameter corresponding to the diameter of the locking rod 3, whereby the locking rod 3 may be received in the axially aligned sleeves 12 and ring 13. Also provided about each of the frustoconical sections of the sleeves 12 is a split ring or spring toggle 14.

Referring now to FIG 1B, arcuately shaped grooves are provided in each of the sleeve shells 11 and 11' generally complementary in interior shape to the external shape of the sleeves and ring 13. The interior surfaces of sleeves 11 and 11' which receive sleeves 12 and ring 13 in assembly open through one end of body 1. Sleeves 11 and 11' each have semi-cylindrical grooves 111 and 112 coaxially arranged such that when the sleeves 11 and 11' are assembled, the interior surfaces 111 and 112 open through the opposite end of body 1 for receiving a locking block 41 on which one end of the wire will be located. The extended ring groove 112 has a comparatively larger bore than recess 111 and is provided to receive a positioning piece 15 sleeved on the wire.

Consequently, when the retention sleeves 12 and ring 13 are inserted in the separated shells 11 and 11' and the locking block 41 and positioning piece 15 on wire 4 are received in the opposite end of the separated shells, the shells may be secured one to the other. Thus, one end of wire 4 is secured in body 1 by the reception of locking block 41 in recess 111 and positioning piece 15 in recess 112.

The locking rod 3 has a plurality of axially spaced circular grooves thereabout for cooperation with the split rings 14 in a manner set forth hereinafter. The location of the ring grooves 32 corresponds to the positions on which the interior ring grooves 113 of the sleeve shells 11, 11' is set. The number of the ring grooves 32 which are to be set on the circular rod 3 depends on the number of the sleeves 12 which are to be set in the interior of the sleeve shell 11, 11'. Furthermore, the spring toggle 14 is split and the clearence 141 of the split can be a very tiny dimension, so that an excellent buckling force can be provided.

As shown in FIG. 2, after the shells 11, 11' have been assembled, and the fixing block 41, located at one end of the wire, set in the interior of the sleeve shell at 111 with positioning piece 15 in a recess adjacent position block, the end of wire 4 will be prevented from pulling out of body 1. In addition, at the time the sleeves 12 are partially telescoped, axially aligned, and set in grooves 113, the spring toggles 14 are located interiorly about and between adjacent sleeves 12. Ring 13 bears against the innermost sleeve 12 so as to prevent the spring toggle 14 from falling off.

Figure 3:
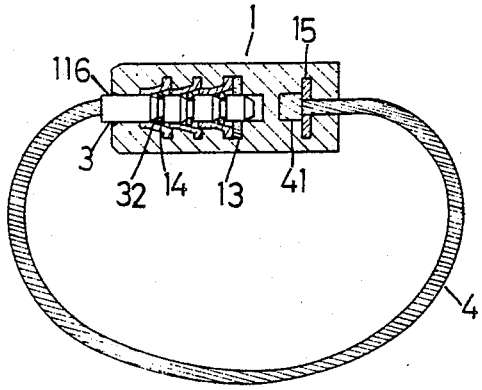
FIG. 3 is a cross-sectional view of the locking seal illustrated in FIG. 1 in locking position.
Figures 1, 4:
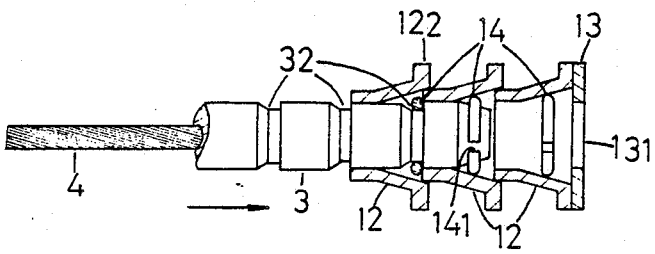
FIGS. 4A and 4B are fragmentary enlarged cross-sectional views of portions of the locking seal hereof illustrating the manner of inserting and retracting the locking rod from the locking retention sleeves.
Figures 2, 4:
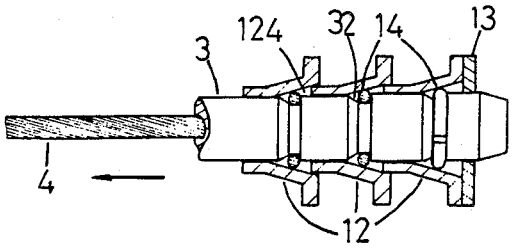

As shown in FIG. 3, when a locking motion is to be conducted by the sealing string or lock of the invention, all one has to do is to insert the circular rod 3 connected at one end of the wire into the female joint hole 116 along the path located at the end of the sleeve body 1 to enable the spring toggles 14 which lie in the space between sleeves 12 and ring 13 to engage in the ring grooves 32 located at the end of the circular rod. It can be seen that after the end of the circular rod 3 has been inserted along the path of the female joint hole 116 located at the end of the sleeve body, each toggle 14 will be caused to move axially toward its interior lateral side because, as is shown in FIG. 4A, the dimension of the circular rod 3 is larger than the bore of the toggle 14. The cone-shaped end 31 of rod 3 has a comparatively larger bore than toggle 14 and causes the toggle to become gradually expanded outward under a pushing force exerted by the circular rod 3, so that a larger bore will be eventually formed. By this time, the circular rod 3 will then be able to pass through the toggle 14. When the circular rod is inserted still further, the springs 14 are expanded and contracted in turn. When someone wants to pull the circular rod 3 in an outward direction as shown in FIG. 4B, each toggle 14 which is contracted on the circular rod ring groove will move toward an outward position. In this manner, as the frustoconically shaped bore of the bore 124 of each sleeve 12 is gradually diminished, the lateral wall of the cone-shaped bore 124 exerts a pressure against the toggle 14, which will in turn further cause the toggle 14 contracted onto the ring groove of the circular rod to produce an even greater contracting force to prevent the rod 3 from being easily pulled away from the sleeve body, so as to achieve the object of locking.

In the forementioned descriptions, the sleeve body 1 can contain one or more sleeves depending on its requirements. Such a design as provided by the invention to enable the maker to decide the number of sleeves to be set according to the strength of tension force required by his clients.

Figures 1, 5:
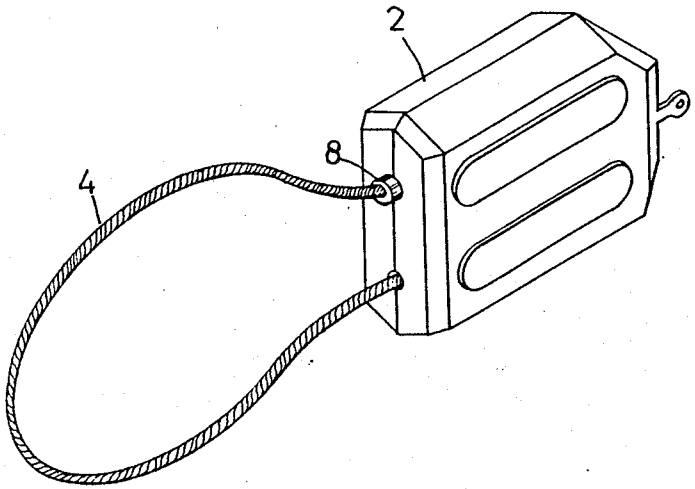
FIG. 5 is a perspective view of a locking seal constructed in accordance with another embodiment hereof.
Figures 2, 5:
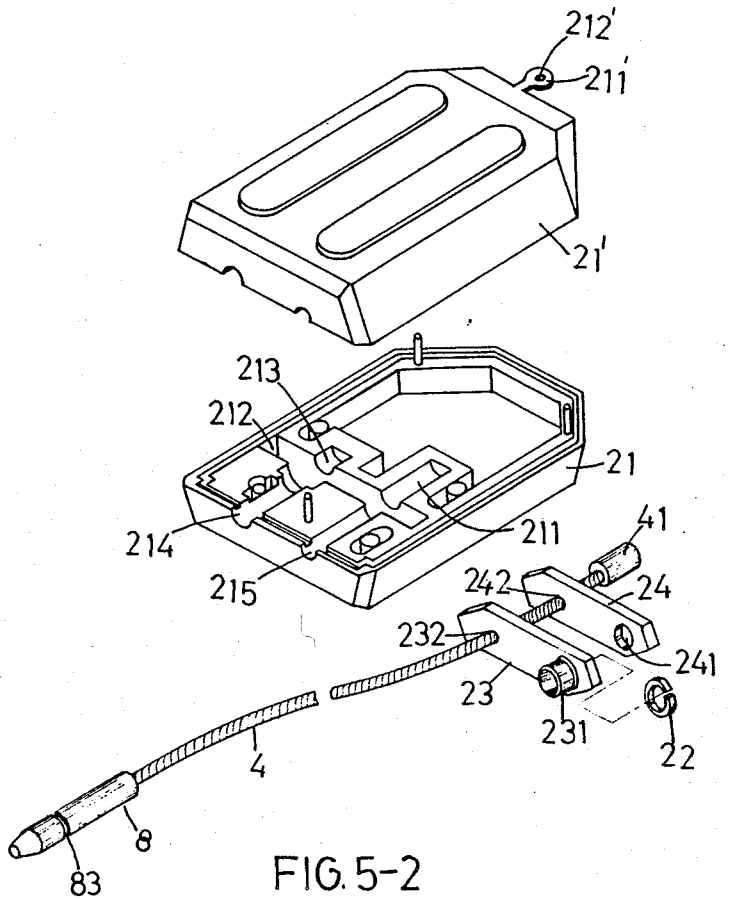
Figure 6:
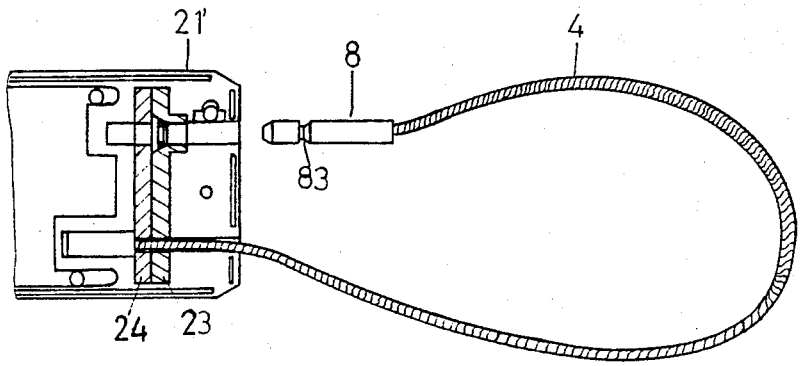
FIG. 6 is an exploded perspective view of the parts comprising the locking seal of the embodiment illustrated in FIG. 5.
Figure 7:
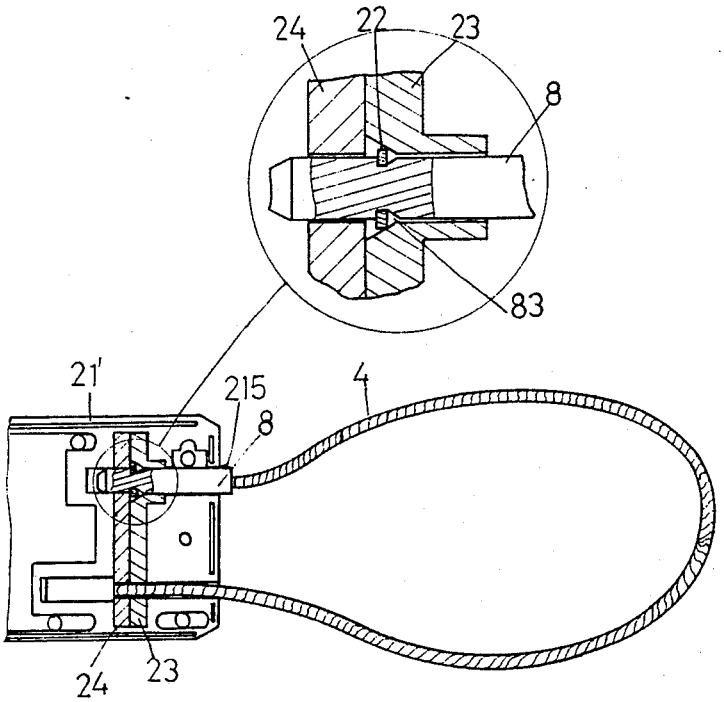
FIGS. 7 and 8 are fragmentary cross-sectional views of a still further embodiment of the present invention.
Figures 1, 8:
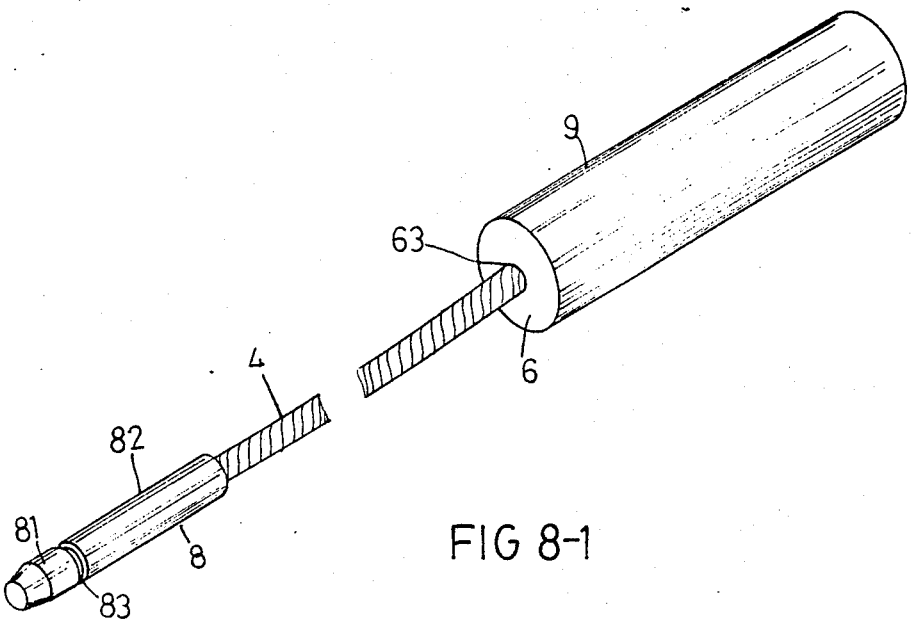
Figures 2, 8:
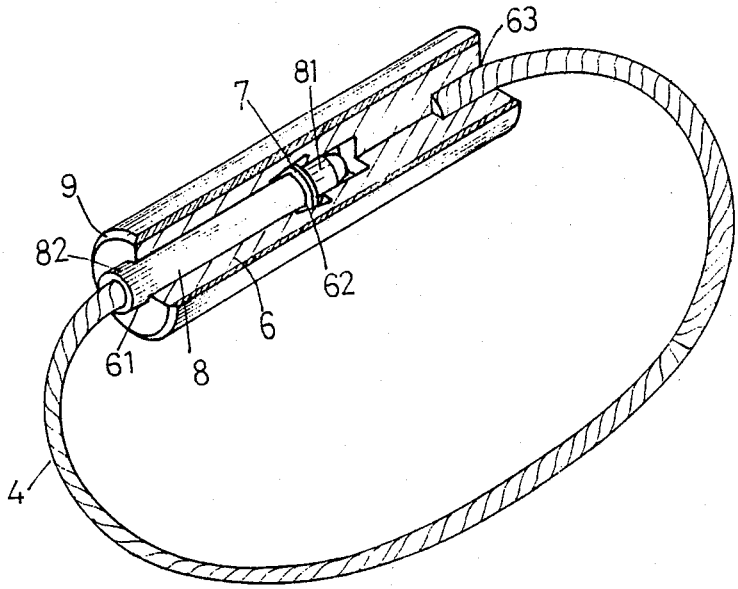

What is indicated in FIGS. 5 and 6 is an example of another embodiment of the invention. In FIG. 6, two metallic sheets 23 and 24 are set in the interior of the two sleeve shells 21, 21', with axially aligned holes 232 and 242 set on their extended plate surfaces, through which holes the wire can pass. A groove 212 is set in the interior of the sleeve shells 21, 21' to match with the length and width of the metallic sheets 23, 24, so that the two metallic sheets 23, 24, after having been juxtaposed, can be exactly inserted and fixed in groove 212. At the time of assembly, the spring toggle 22 is placed into the cone-shaped ring groove 231. Furthermore, after a proper alignment has been made, another plate-shaped metallic sheet 24 is located in the groove 212 of shell 21. The end of fixing block 41 will be placed into the ring groove 213 of the sleeve shell and the extended wire can be vertically placed at the wire hole 214. The frustoconically shaped concave groove 231 of the metallic sheets 23, 24 is arranged in alignment with the sleeve hole 215. Finally, the two sleeve shells 21, 21' are aligned and fixed together. In this way, the sealing lock will be completed as shown in FIG. 6.

On the other hand, a projecting piece 211' with a circular hole 212' can be extended from an end of the sleeve shell 21' of the lock seal as indicated in FIG. 6 to enable the user to hook a rope or wire into the circular hole 212' of the projected piece, so as to facilitate carrying several lock seals at one time. At the time of utilization, it can be conveniently taken off by breaking off the extended part of the body of the projected piece.

The main feature of the design of the present invention lies in directly placing the pre-fabricated sleeves 12 into the plastic sleeve shell and then have the two half-pieces of the sleeve shell sealed together. In this way, the sealing process will be completed. The present invention also features that the number of the sleeves 12 can be either increased or reduced depending upon actual requirements, thus providing a great convenience for the fabrication of the body 1. The sleeve shells can also be made of plastic and the sleeves 12 can be used to match with the spring toggles to form buckling devices, which will also reduce cost. Moreover, the spring toggles being presented by this invention can be directly inserted into the frustoconically shaped openings of the sleeves. That is why the clearence of its gap is of a rather small dimensions, so as to raise the force which is being applied to buckling on the circular rod.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A lock seal comprising:

a housing;

at least two lock retention sleeves disposed in said housing, each of said sleeves having a frustoconical portion defining large and small diameter opposite ends and a radially outwardly directed flange adjacent the larger diameter end thereof extending in a plane generally normal to the axes of said frustoconical sleeve portion, said sleeve being axially aligned within said housing;

a split ring disposed within each of the frustoconical portions of the sleeves;

means for retaining the split ring within said sleeve and enabling axial movement thereof;

a flexible element having opposite ends;

means cooperable between one end of said element and said housing for retaining the one end of said element in said housing; and a pin carried by the opposite end of said flexible element and receivable axially within said sleeves, said pin having a plurality of circumferentially extending, axially spaced grooves, said split ring having an internal diameter smaller than the diameter of said pin such that each ring will at first expand upon insertion of the pin and then contract in a pin groove to retain the pin within the body upon attempted retracting movement of the pin from the body.

2. A lock seal according to claim 1 wherein said housing is generally elongated and tubular and is split lengthwise to form generally elongated semi-cylindrical shells, each said shell having interior surface complementary in shape to correspond to the frustoconical and flanged portions of said sleeves whereby, upon assembly and securement of said shells one to the other, said sleeves and said rings are retained within said housing.

3. A locking seal according to claim 1 wherein said sleeves are formed of sheetmetal punched to form said flange and frustoconical portions.

* * * * *